US005699483A

United States Patent [19]

Tanaka

[11] Patent Number: 5,699,483

[45] Date of Patent: Dec. 16, 1997

[54] CODE EXCITED LINEAR PREDICTION CODER WITH A SHORT-LENGTH CODEBOOK FOR MODELING SPEECH HAVING LOCAL PEAK

[75] Inventor: Naoya Tanaka, Yokohama, Japan

[73] Assignee: Matsushita Electric Industrial Co., Ltd., Osaka, Japan

[21] Appl. No.: 490,253

[22] Filed: Jun. 14, 1995

[30] Foreign Application Priority Data

Jun. 14, 1994 [JP] Japan ..... 6-131889
Dec. 22, 1994 [JP] Japan ..... 6-320237

[51] Int. Cl.[6] ..... G10L 9/14

[52] U.S. Cl. ..... 395/2.28; 395/2.27; 395/2.29; 395/2.31; 395/2.32

[58] Field of Search ..... 395/2.27, 2.28, 395/2.29, 2.31, 2.32

[56] References Cited

U.S. PATENT DOCUMENTS

| | | | |
|---|---|---|---|
| 4,852,179 | 7/1989 | Fette | 395/2.39 |
| 5,086,439 | 2/1992 | Asai et al. | 375/241 |
| 5,194,950 | 3/1993 | Murakami et al. | 348/417 |
| 5,208,862 | 5/1993 | Ozawa | 395/2.25 |

OTHER PUBLICATIONS

Kazunori Ozawa, Masahiro Serisawa, Tohiki Miyano, and Toshiyuki Nomura, "M-LCELP Speech Coding at 4 KBPS", Proceedings of the IEEE ICASSP '94, p.I.269–I.272, Apr. 1994.

Andreas S. Spanias, "Speech Coding: A Tutorial Review", Proceedings of the IEEE, vol. 82, pp. 1541–1582, Oct. 1994.

*Primary Examiner*—Allen R. MacDonald
*Assistant Examiner*—Tālivaldis Ivars Šmit
*Attorney, Agent, or Firm*—Lowe, Price, LeBlanc & Becker

[57] ABSTRACT

A predicted residual signal is calculated from a current input speech signal and a past input speech signal, and a cross-correlation between the predicted residual signal and the past input speech signal having one speech sub-frame length stored in a first code book is calculated. In cases where the current input speech signal has no local peak, the cross-correlation becomes high, so that a synthesized speech signal is generated from the past input speech signal stored in the first code book or a predetermined sound source signal having one speech sub-frame length stored in the second code book. In contrast, in cases where the current input speech signal has a local peak, the cross-correlation becomes low, so that it is judged that a function of the first code book is depressed. In this case, a synthesized speech signal is generated from a group of short-length sound source signals having a total length equal to one speech sub-frame length stored in a short-length signal code book. Therefore, even though the current input speech signal suddenly has a local peak, because the synthesized speech signal is generated from the short-length sound source signals respectively having a speech length lower than one speech sub-frame length, the local peak can be expressed by the short-length sound source signals, an appropriate exciting sound source signal similar to the current input speech signal can be determined, and the synthesized speech signal can be adequately obtained.

10 Claims, 4 Drawing Sheets

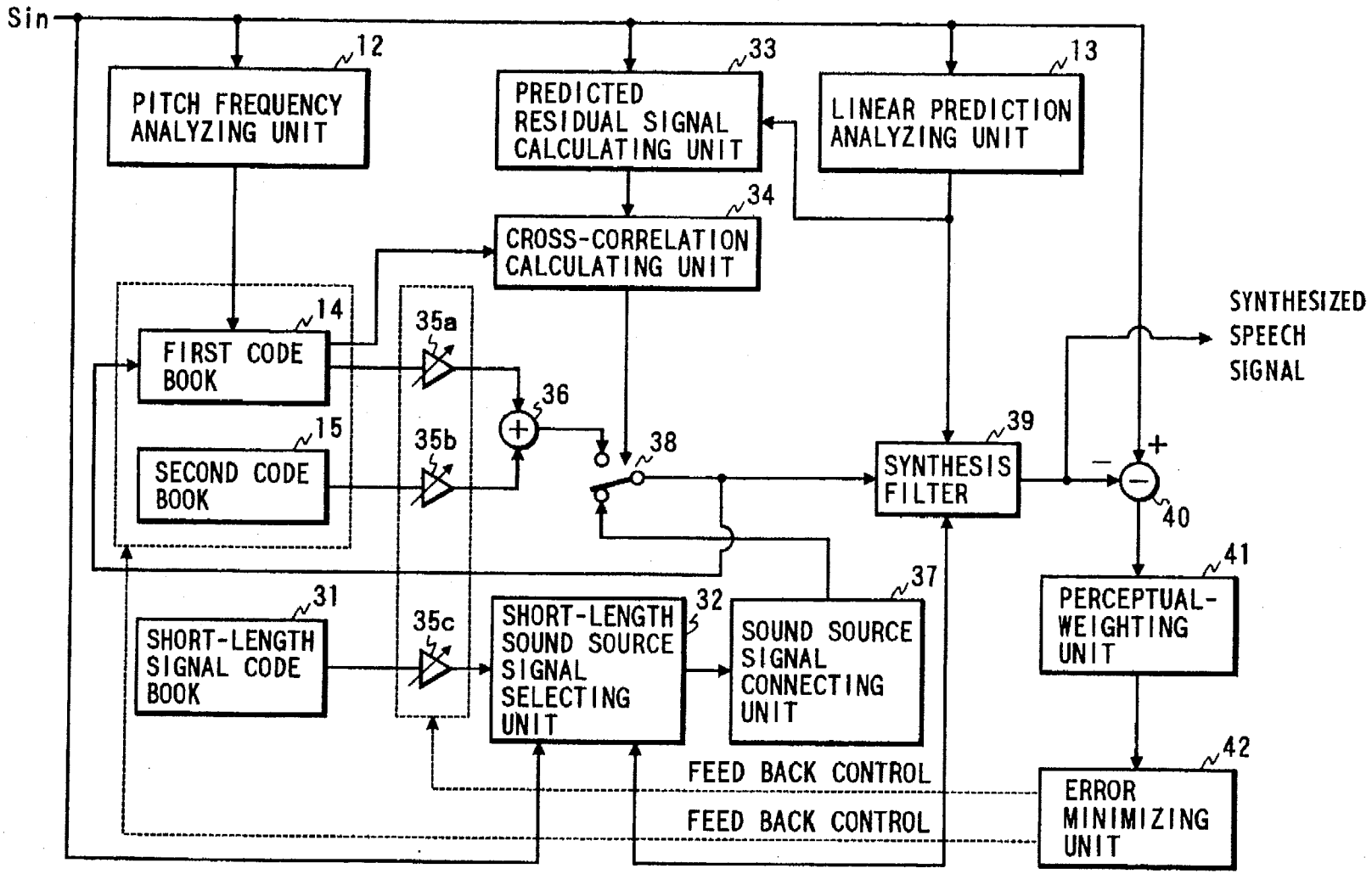
FIG. 2
Sin
PITCH FREQUENCY ANALYZING UNIT
12
LINEAR PREDICTION ANALYZING UNIT
13
PREDICTED RESIDUAL SIGNAL CALCULATING UNIT
33
CROSS-CORRELATION CALCULATING UNIT
34
FIRST CODE BOOK
14
SECOND CODE BOOK
15
SHORT-LENGTH SIGNAL CODE BOOK
31
35a
35b
35c
36
38
SHORT-LENGTH SOUND SOURCE SIGNAL SELECTING UNIT
32
SOUND SOURCE SIGNAL CONNECTING UNIT
37
SYNTHESIS FILTER
39
40
SYNTHESIZED SPEECH SIGNAL
PERCEPTUAL-WEIGHTING UNIT
41
ERROR MINIMIZING UNIT
42
FEED BACK CONTROL
FEED BACK CONTROL

CODE EXCITED LINEAR PREDICTION CODER WITH A SHORT-LENGTH CODEBOOK FOR MODELING SPEECH HAVING LOCAL PEAK

BACKGROUND OF THE INVENTION

1. Field of the Invention

The present invention relates generally to a speech coding apparatus in which speech or voice is coded at a range from 4 to 8 kbit-rate (kbits per second), and more particularly to a speech coding apparatus in which speech quality is improved by switching a code book and a selection-frequency of a sound source signal according to features of an input speech.

2. Description of the Prior Art

As a speech coding apparatus in which a speech is coded at a bit-rate range from 4 to 8 kbits per second, an apparatus in which a past input speech signal is divided into a plurality of divided speech signals of speech frames respectively having the same predetermined time-length, each of the divided speech signals is analyzed to calculate spectrum parameters, a synthesis filter having the spectrum parameters as filter coefficients is excited in response to a sound source signal selected in a first code book and another sound source signal selected in a second code book, and a synthesized speech signal is obtained is well-known. Such a speech coding method is called a code excited linear prediction coding (CELP). In the CELP, each of the divided speech signals at the speech frames is generally subdivided into a plurality of subdivided speech signals at speech sub-frames respectively having the same more shortened time-length, and a plurality of past sound source signals of the speech sub-frames are stored in the first code book. Also, a plurality of predetermined sound source signals respectively having a predetermined wave-shape are stored in the second code book. A series of speech sub-frames of the first code book is taken out according to a pitch frequency of a current input speech signal currently obtained. Also, a series of predetermined sound source signals of the second code book judged most appropriate as sound source signals is taken out. A series of sound source signals (hereinafter, called a series of excitation sound source signals) input to the synthesis filter is generated by linearly adding the series of speech sub-frames taken out from the first code book and the series of predetermined sound source signals taken out from the second code book.

2.1. Previously Proposed Art

A conventional speech coding apparatus is described with reference to FIG. 1.

FIG. 1 is a block diagram of a conventional speech coding apparatus.

As shown in FIG. 1, a conventional speech coding apparatus 11 is provided with a pitch frequency analyzing Unit 12 for extracting a pitch frequency from a current input speech signal Sin currently input, a linear prediction analyzing unit 13 for generating a plurality of linear prediction coefficients from a plurality of samples of past and current input speech signals Sin to use the linear prediction coefficients for the prediction of an input speech signal Sin subsequent to the past input speech signals Sin, a first code book 14 for storing a plurality of past sound source signals, a second code book 15 for storing a plurality of first predetermined sound source signals having first predetermined wave-shapes, an adder 18 for linearly adding a past sound source signal selected in the first code book 14 and a first predetermined sound source signal selected in the second code book 15 to generate an excitation sound source signal, a synthesized filter 17 for generating a synthesized speech signal from the excitation sound source signal according to the linear prediction coefficients, a subtracter 18 for subtracting the synthesized speech signal from the current input speech signal Sin to generate an error, a perceptual-weighting unit 19 for weighting the error, an error minimising unit 20 for controlling the selection of the sound source signals performed in the first and second code books 14 and 15 and controlling gains (or intensities) of the sound source signals selected in the first and second code books 14 and 15 to minimize the error.

In the above configuration, an operation performed in the conventional speech coding apparatus 11 is described.

As shown in FIG. 1, in the linear prediction analyzing unit 13, a plurality of linear prediction coefficients $\alpha i$ (i=1 to p) are generated in advance from a plurality of samples of past and current input speech signals Sin to use the linear prediction coefficients for the prediction of the current input speech signal Sin. That is, the linear prediction is, for example, expressed according to an equation (1).

$$Y_n(\text{pre})=\alpha_1 Y_{n-1}+\alpha_2 Y_{n-2}+\cdots+\alpha_p Y_{n-p} \quad (1)$$

Here the symbols $Y_{n-1}$ denote sample values (or amplitudes) of the past input speech signals Sin and the symbol $Y_n$(pre) denotes a sample value (or amplitude) of a predicted input speech signal currently input.

Thereafter, a pitch frequency is extracted from the current input speech signal Sin in the pitch frequency analyzing unit 12. In this case, there is a possibility that an error occurs in the extraction of the pitch frequency, a plurality of pitch frequencies are extracted as candidates for an actually used pitch frequency from the current input speech signal Sin in a practical operation. Thereafter, in cases where the pitch frequency is equal to or longer than a time-length of one speech sub-frame, a past sound source signal having a particular time-length corresponding to the pitch frequency is taken out from the first code book 14 every pitch frequency. Also, in cases where the pitch frequency is shorter than the time-length of one speech sub-frame, a past sound source signal is taken out from the first code book 14 every pitch frequency, and a plurality of past sound source signals are connected with each other in series every speech sub-frame to form a combined past sound source signal having the same speech length as the time-length of one speech sub-frame. Thereafter, a series of past sound source signals (or a series of combined past sound source signals) taken out from the first code book 14 and a first predetermined sound source signal taken out from the second code book 15 are linearly added in the adder 16 to generate an excitation sound source signal. Thereafter, the excitation sound source signal is fed back to the first code book 14 as an updated past sound source signal which is delayed by one speech sub-frame as compared with the past sound source signal originally stored in the first code book 14. Therefore, the past sound source signals stored in the first code book 14 are renewed by receiving the excitation sound source signal as an updated past sound source signal each time one speech sub-frame passes. Also, the synthesis filter 17 is formed from the linear prediction coefficients, and the excitation sound source signal is changed to a synthesized speech signal in the synthesis filter 17. Thereafter, a difference between the current input speech signal Sin and the synthesized speech signal is calculated in the subtracter 18 to obtain an error, and the error is weighted in the perceptual-weighting unit 19. Thereafter, feed back signals are generated in the error minimizing unit 20 according to the weighted error, and the feed back signals are transferred to the first and second code books 14 and 15 to control the selection of the sound source signals and to control gains (or intensities) of the sound source signals selected in the first and second code books 14 and 15 for the purpose of minimizing the error. Therefore, an appropriate excitation sound source signal and an appropriate gain (or intensity) of the excitation sound source signal are determined.

Accordingly, in cases where the input speech signals Sin are always set in a stationary condition, an appropriate excitation sound source signal with which the difference between the synthesis speech signal and the input speech signal Sin is sufficiently minimized can be obtained in the conventional speech coding apparatus 11, and a high speech quality can be obtained.

2.2. Problems to be Solved by the Invention

However, in cases where an intensity of the input speech signal Sin suddenly varies in a series of input speech signals Sin, the excitation sound source signal relating to the input speech signal Sin also varies in a great degree, and a wave-shape of the excitation sound source signal greatly varies to have a local peak. In particular, when an intensity of the input speech signal Sin varies at a leading edge of a voiced sound, it is required that a portion of the excitation sound source signal relating to the leading edge of the voiced sound considerably varies. In this case, the function of the first code book 14 is depressed, and a large variation in the excitation sound source signal cannot be obtained with high accuracy. That is, in cases where the periodicity of the input speech signals Sin input in series cannot be successfully utilized because of a sudden change of the current input speech signal Sin, a difference between the past sound source signal taken out from the first code book 14 and a past sound source signal from which a synthesized speech signal having the minimum difference from the current input speech signal Sin is generated in the synthesis filter 17 is considerably increased. This phenomenon is called the depression of the function of the first code book 14. Therefore, there is a problem that a speech quality deteriorates.

To solve the above problem, as shown in FIG. 1, the conventional speech coding apparatus 11 is additionally provided with a third code book 21 for storing a plurality of second predetermined sound source signals having second predetermined wave-shapes, a Judging unit 22 for judging whether or not a function of the first code book 14 is depressed, and a selector switch 28 for switching from the first code book 14 to the third code book 21 when it is judged by the judging unit 22 that the function of the first code book 14 is depressed. In the above configuration, an excitation sound source signal is formed by combining the second predetermined sound source signal of the third code book 21 and the first predetermined sound source signal of the second code book 15 when it is Judged by the Judging unit 22 that the function of the first code book 14 is depressed.

However, because the speech sub-frame has a length corresponding to a sample frequency ranging from 40 to 80 samples per sub-frame and the sound source signal having almost the same length as that of the speech sub-frame is taken out from the first or third code book 14 or 21 selected, there is a problem that an excitation sound source signal required to locally have a peak cannot be formed with a high accuracy.

SUMMARY OF THE INVENTION

An object of the present invention is to provide, with due consideration to the drawbacks of such a conventional speech coding apparatus, a speech coding apparatus in which an excitation sound source signal required to locally have a peak is formed with a high accuracy to improve a speech quality even though a function of a first code book is depressed.

The object is achieved by the provision of a speech coding apparatus, comprising:

a first code book for storing a plurality of first sound source signals respectively having a first length;

a short-length signal code book for storing a plurality of short-length sound source signals respectively having a second length shorter than the first length;

function detecting means for analyzing an input speech signal to detect whether or not a function of the first code book is depressed;

selecting means for selecting the first code book to take out a first sound source signal from the first code book in cases where it is detected by the function detecting means that the function of the first code book is not depressed and selecting the short-length signal code book to take out a plurality of short-length sound source signals from the short-length signal code book in cases where it is detected by the function detecting means that the function of the first code book is depressed, a total length of the short-length sound source signals being equal to the first length;

a synthesis filter for generating a synthesized speech signal from the first sound source signal or the short-length sound source signals which are taken out from the first code book or the short-length signal code book selected by the selecting means; and controlling means for controlling the first sound source signal or the short-length sound source signals which are taken out from the first code book or the short-length signal code book selected by the selecting means to reduce a difference between the input speech signal and the synthesized speech signal generated by the synthesis filter.

In the above configuration, when an input speech signal has not local a peak, the intensity of the input speech signal does not suddenly vary. Therefore, the function of the first code book is not depressed. In this case, the first code book is selected by the selecting means, and a first sound source signal is taken out from the first code book under the control of the controlling means. The first sound source signal is changed to a synthesized speech signal in the synthesis filter. Because the first sound source signal is taken out under the control of the controlling means, the synthesized speech signal is almost the same as the input speech signal. Therefore, the input speech signal can be expressed by the synthesized speech signal. That is, the input speech signal can be accurately coded to the synthesized speech signal in the speech coding apparatus.

In contrast, when the input speech signal has a local peak, the intensity of the input speech signal suddenly varies. In this case, even though a first sound source signal is taken out from the first code book under the control of the controlling means, a synthesized speech signal locally having the same peak cannot be adequately generated from the the first sound source signal in the synthesis filter. Therefore, it is detected by the function detecting means that the function of the first code book is depressed, and the short-length signal code book is selected by the selecting means. Thereafter, a plurality of short-length sound source signals are taken out in series from the short-length signal code book under the control of the controlling means and are changed to a synthesized speech signal in the synthesis filter, Because the short-length sound source signals respectively have the second length shorter than the first length and are taken out under the control of the controlling means, the input speech signal is accurately expressed by the synthesized speech signal even though the input speech signal has a local peak. Therefore, even though the input speech signal has a local peak, the input speech signal can be accurately coded to the synthesized speech signal in the speech coding apparatus.

Also, the object is achieved by the provision of a speech coding apparatus, comprising:

a first code book for storing a plurality of past sound source signals respectively having a first length of one speech sub-frame, the past sound source signals being formed of a past input speech signal preceding to a current input speech signal currently input;

a second code book for storing a plurality of predetermined sound source signals respectively having the first length of one speech sub-frame length;

a short-length signal code book for storing a plurality of short-length sound source signals respectively having a second length of one micro-frame shorter than the first length, a plurality of speech micro-frames being formed by dividing one speech sub-frame;

linear prediction analyzing means for analyzing the past input speech signal and the current input speech signal to calculate a plurality of linear prediction coefficients;

prediction residual signal calculating means for calculating a predicted residual signal indicating a predicted residual between the current input speech signal and a predicted input speech signal which is obtained by using the linear prediction coefficients calculated by the linear prediction analyzing means;

cross-correlation calculating means for calculating a cross-correlation between a past sound source signal taken out from the first code book and the predicted residual signal calculated by the prediction residual signal calculating means to detect the depression of a function of the first code book according to a degree of the cross-correlation;

adding means for linearly adding the past sound source signal taken out from the first code book and a predetermined sound source signal taken out from the second code book to form a first excitation sound source signal, a total length of the first excitation sound source signal being equal to the first length;

short-length signal connecting means for connecting a plurality of short-length sound source signals taken out from the short-length signal code book in series to form a second excitation sound source signal, a total length of the second excitation sound source signal being equal to the first length;

selecting means for selecting the first excitation sound source signal obtained in the adding means in cases where it is detected by the cross-correlation calculating means that the function of the first code book is not depressed and selecting the second excitation sound source signal obtained in the short-length signal connecting means in cases where it is detected by the cross-correlation calculating means that the function of the first code book is depressed;

a synthesis filter for generating a synthesized speech signal from the first excitation sound source signal or the second excitation sound source signal selected by the selecting means according to the linear prediction coefficients calculated by the linear prediction analyzing means; and controlling means for controlling the past sound source signal taken out from the first code book to the adding means and the short-length sound source signals taken out from the short-length signal code book to reduce a difference between the current input speech signal and the synthesized speech signal generated by the synthesis filter.

In the above configuration, a current input speech signal currently input and a past input speech signal preceding to the current input speech signal currently input is analyzed in the linear prediction analyzing means, and a plurality of linear prediction coefficients are calculated. Therefore, a predicted input speech signal is obtained by using the linear prediction coefficients. Thereafter, a predicted residual signal indicating a predicted residual between the current input speech signal and the predicted input speech signal is calculated in the prediction residual signal calculating means, and a cross-correlation between a past sound source signal taken out from the first code book and the predicted residual signal is calculated in the cross-correlation calculating means.

In cases where a degree of the cross-correlation is high, it is judged that the current input speech signal has not locally any peak to suddenly change its intensity. Therefore, because the current input speech signal can be expressed by a synthesized -speech signal generated from a past sound source signal stored in the first code book, it is detected by the cross-correlation calculating means that a function of the first code book is not depressed.

In this case, the past sound source signal taken out from the first code book and a predetermined sound source signal taken out from the second code book under the control of the controlling means are linearly added in the adding means. In other words, the past sound source signal and the predetermined sound source signal are superposed each other. Therefore, a first excitation sound source signal having the first length is formed. Thereafter, a synthesized speech signal is generated from the first, excitation sound source signal according to the linear prediction coefficients. In other words, the predicted input speech signal calculated with the linear prediction coefficients is added to the first excitation sound source signal. In cases where a difference between the current input speech signal and the synthesized speech signal is large, the selection of the past sound source signal taken out from the first code book and the predetermined sound source signal taken out from the second code book is controlled by the controlling means to reduced the difference. Therefore, the input speech signal can be expressed by the synthesis speech signal. That is, the input speech signal can be accurately coded to the synthesized speech signal in the speech coding apparatus.

In contrast, in cases where a degree of the cross-correlation is low, it is Judged that the current input speech signal has locally a peak to suddenly change its intensity. Therefore, because the current input speech signal cannot be expressed by a synthesized speech signal generated from a past sound source signal stored in the first code book, it is detected by the cross-correlation calculating means that a function of the first code book is depressed.

In this case, a plurality of short-length sound source signals are taken out from the short-length signal code book in series under the control of the controlling means and are connected in the short-length signal connecting means to form a second excitation sound source signal having the first length. Thereafter the second excitation sound source signal is selected by the selecting means, and a synthesized speech signal is generated from the second excitation sound source signal according to the linear prediction coefficients.

Accordingly, because the short-length sound source signals respectively have the second length shorter than the first length and are taken out under the control of the controlling means, the input speech signal is accurately expressed by the synthesized speech signal even though the input speech signal has locally a peak. Therefore, even though the input speech signal has locally a peak, the input speech signal can be accurately coded to the synthesized speech signal in the speech coding apparatus.

BRIEF DESCRIPTION OF THE DRAWINGS

The objects, features and advantages of the present invention will be apparent from the following description taken in conjunction with the accompanying drawings, in which:

FIG. 2 is a block diagram of a speech coding apparatus according to an embodiment of the present invention;

DESCRIPTION OF THE PREFERRED EMBODIMENTS

Figure 1:
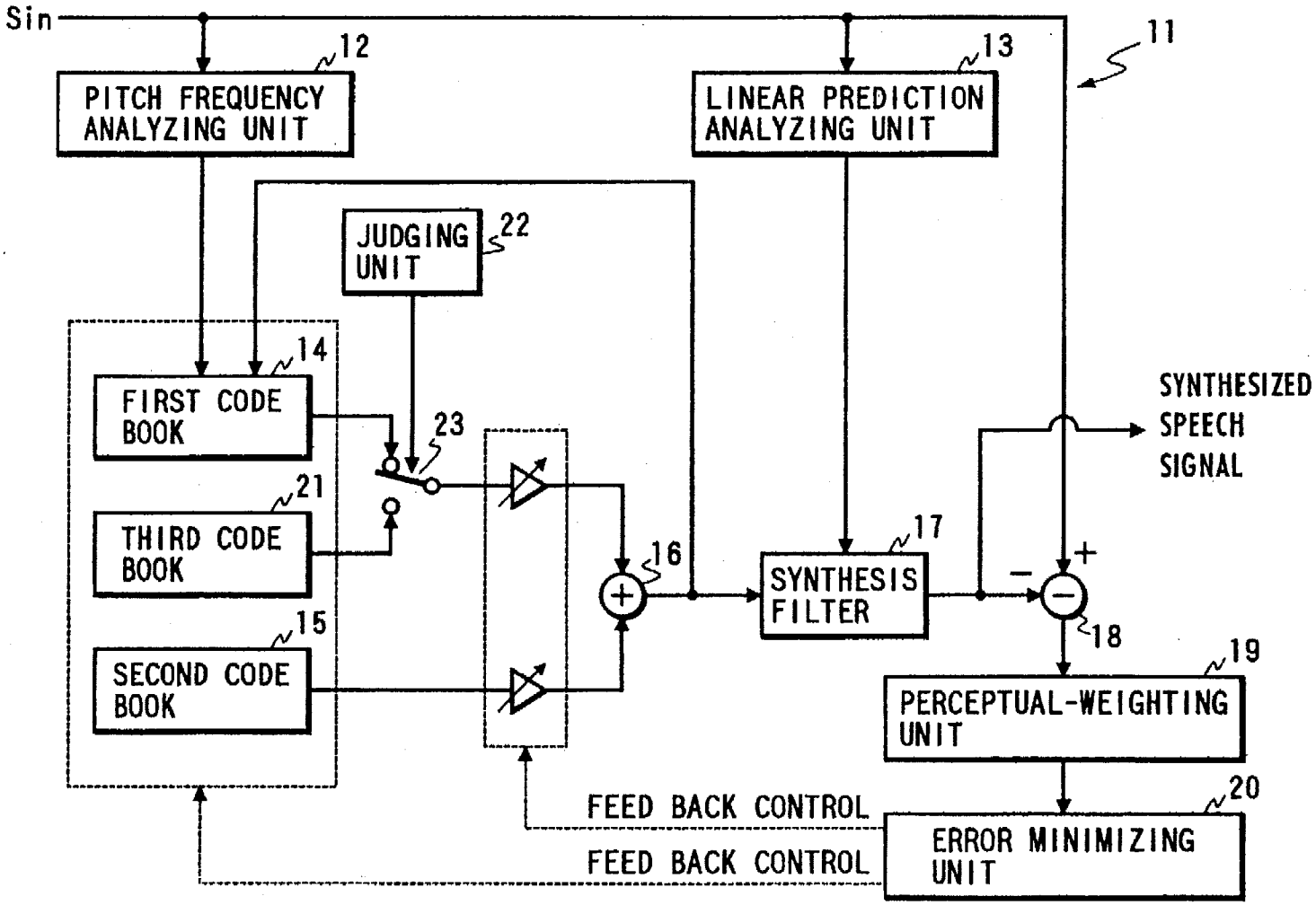
FIG. 1 PRIOR ART
FIG. 1 is a block diagram of a conventional speech coding apparatus.

Preferred embodiments of a speech coding apparatus according to the present invention are described with reference to drawings.

FIG. 2 is a block diagram of a speech coding apparatus according to an embodiment of the present invention.

As shown in FIG. 2, a speech coding apparatus 30 comprises the pitch frequency analyzing unit 12, the linear prediction analyzing unit 18, the first code book 14, the second code book 15, a short-length signal code book 31 for storing a plurality of short-length sound source signals respectively having a shorter signal length than those of the predetermined sound source signals stored in the second and short-length signal code books 15 and 21, a short-length sound source signal selecting unit 32 for selecting a series of short-length sound source signals taking out from the short-length signal code book 31, a prediction residual signal calculating unit 33 for calculating a predicted residual signal indicating a predicted residual (or a predicted error) between the current input speech signal Sin and the predicted input speech signal with the sample value $Y_n$(pre) calculated by using the linear prediction coefficients generated by the linear prediction analyzing unit 18, a cross-correlation calculating unit 84 for calculating a cross-correlation between a past sound source signal of the first code book 14 and the predicted residual signal calculated by the prediction residual signal calculating unit 33 to detect the depression of the function of the first code book 14 according to a degree of the cross-correlation, three gain adjusting units 35*a*, 35*b* and 35*c* for adjusting gains of sound source signals taken out from the first, second and short-length signal code books 14, 15 and 31, an adder 36 for linearly adding a past sound source signal selected in the first code book 14 and a predetermined sound source signal selected in the second code book 15 to generate a first excitation sound source signal, a sound source signal connecting unit 37 for connecting the series of short-length sound source signals taken out from the short-length signal code book 31 under the control of the short-length sound source signal selecting unit 32 to generate a second excitation sound source signal having a length of one speech sub-frame, a selector switch 38 for switching the selection of the first or second excitation sound source signal according to a detecting signal transferred from the cross-correlation calculating unit 34, a synthesis filter 39 for generating a synthesized speech signal from the first or second exciting sound source signal selected in the selector switch 38 according to the linear prediction coefficients, a subtracter 40 for subtracting the synthesized speech signal from the current input speech signal Sin to generate an error, a perceptual-weighting unit 41 for weighting the error, an error minimizing unit 42 for controlling the selection of the sound source signals performed in the first and second code books 14 and 15 and controlling the gain adjusting units 35*a*, 35*b* and 35*c* to control gains (or amplitudes) of the sound source signals selected in the first, second and short-length signal code books 14, 15 and 31 for the purpose of minimizing the error. In the above configuration, an operation performed in the speech coding apparatus 30 is described.

In the linear prediction analyzing unit 13, the linear prediction coefficients $\alpha i$ are generated in advance from a plurality of samples of past and current input speech signals Sin to use the linear prediction coefficients for the prediction of a current input speech signal Sin currently input, in the same manner as in the conventional speech coding apparatus 11. Thereafter, in the pitch frequency analyzing unit 12, a plurality of pitch frequencies are extracted from the current input speech signal Sin and one of the pitch frequencies is selected and transferred to the first code book 14.

In the predicted residual signal calculating unit 33, a predicted residual signal is calculated by using the linear prediction coefficients generated by the linear prediction analyzing unit 13 and the current input speech signal Sin. The predicted residual signal indicates a predicted residual $\epsilon_n$ (or a predicted error) between the current input speech signal Sin and the predicted input speech signal with the sample value $Y_n$(pre). The predicted residual $\epsilon_n$ is, for example, expressed according to an equation (2).

$$\epsilon_n = Y_n - Y_n(\text{pre}) \tag{2}$$

Here, the sample value $Y_n$(pre) is defined in the equation (1), and a symbol $Y_n$ denotes an actual value (or amplitude) of the current input speech signal Sin.

Thereafter, in the cross-correlation calculating unit 34, it is detected whether or not the function of the first code book 14 is depressed. In detail, a cross-correlation between a past sound source signal of the first code book 14 and the predicted residual signal calculated by the prediction residual signal calculating unit 83 is calculated, and the depression of the first code book 14 is detected according to a degree of the cross-correlation.

In case where the first code book 14 sufficiently functions, the selector switch 38 connects the first and second code books 14 and 15 to the synthesis filter 39 under the control of the cross-correlation calculating unit 34, and a past sound source signal having the same length as that of one speech sub-frame is taken out from the first code book 14 according to the pitch frequency obtained in the pitch frequency analyzing unit 12, and a predetermined sound source signal having the same length as that of one speech sub-frame is taken out from the second code book 15. Thereafter, a first excitation sound source signal having one speech sub-frame length is formed by linearly adding the past sound source signal and the predetermined sound source signal in the adder 36. That is, the past sound source signal and the predetermined sound source signal are superposed each other. Thereafter, the first excitation sound source signal is fed back to the first code book 14 as a signal delayed by one speech sub-frame. Therefore, the past sound source signals stored in the first code book 14 are renewed by receiving the first excitation sound source signal as an updated past sound source signal each time one speech sub-frame passes. Also, the synthesized filter 39 is formed from the linear prediction coefficients, and a synthesis speech signal is generated from the first excitation sound source signal in the synthesis filter 39 by excitation the synthesis filter 39 with the first exciting sound source signal. In other words, a predicted speech signal calculated by using the linear prediction coefficients and the first excitation sound source signal are added according to an equation (3).

$$\overline{Y}_n=\alpha_1\overline{Y}_{n-1}+\alpha_2\overline{Y}_{n-2}+\cdots\alpha_p\overline{Y}_{n-p}+\overline{\epsilon}_n \quad (3)$$

Here, the symbol $\overline{Y}_n$ denotes an amplitude of the excitation speech signal, the symbols $\overline{Y}_{n-1}$, $\overline{Y}_{n-2}$, —, $\overline{Y}_{n-p}$ denote amplitudes of past synthesized speech signals previously generated in the synthesis filter 39, a term $\alpha_1\overline{Y}_{n-1}+\alpha_2\overline{Y}_{n-2}+\text{—}+\alpha_p\overline{Y}_{n-p}$ denotes an amplitude of the predicted speech signal, and the symbol $\overline{\alpha}_n$ denotes an amplitude of the first or second excitation sound source signal.

Thereafter, a difference between the current input speech signal Sin and the synthesized speech signal generated from the first excitation sound source signal in the synthesis filter 39 is calculated in the subtracter 40 to obtain an error $Y_n-\overline{Y}_n$, and the error is weighted in the perceptual-weighting unit 41. Thereafter, feed back signals are generated in the error minimizing unit 42 according to the weighted error, and the feed back signals are transferred to the first, second code books 14 and 15 and the gain adjusting units 35*a* and 35*b* to control the selection of the sound source signals and gains (or amplitudes) of the sound source signals for the purpose of minimizing the error.

Accordingly, an appropriate excitation sound source signal and an appropriate gain (or amplitude) of the excitation sound source signal are determined when the first code book 14 sufficiently functions.

In contrast, in case where the function of the first code book 14 is depressed, the selector switch 38 connects the short-length signal code book 31 to the synthesis filter 39 under the control of the cross-correlation calculating unit 34, and a plurality of short-length sound source signals respectively having a length of one speech micro-frame are taken out from the short-length signal code book 31 in series under the control of the short-length sound source signal selecting unit 32 on condition that the current input speech signal Sin is expressed by a synthesized speech signal generated in the synthesis filter 39. Also, gains of the short-length sound source signals are controlled by the error minimizing unit 42. A plurality of speech micro-frames are obtained by subdividing a speech sub-frame. Thereafter, in the sound source signal connecting unit 37, the short-length sound source signals are connected each other to obtain a second excitation sound source signal having the length of one sub-frame. Thereafter, the synthesized filter 39 is formed from the linear prediction coefficients, and a synthesis speech signal is generated from the second excitation sound source signal in the synthesis filter 39.

Accordingly, because the synthesized speech signal is generated from the short-length sound source signals respectively having one speech micro-frame length, even though the current input speech signal Sin has locally a peak, the local peak can be expressed by the short-length sound source signals respectively having one speech micro-frame length. Therefore, an appropriate excitation sound source signal and an appropriate gain (or amplitude) of the excitation sound source signal are determined even though a function of the first code book 14 is depressed.

In the above embodiment, the predicted residual signal is used as a target for the generation of the first or second excitation sound source signal according to the equation (2). Therefore, the quality of a synthesized speech represented by the synthesis sound source signal depends on to what degree of accuracy the past sound source signals of the first code book 14 express the predicted residual signal. Therefore, the cross-correlation between the past sound source signal of the first code book 14 and the predicted residual signal is calculated, the degree of the cross-correlation is detected, and the depression of the function of the first code book 14 can be detected.

Next, the second, excitation sound source signal generated by connecting the short-length sound source signals taken out from the short-length signal code book 31 in cases where the function of the first code book 14 is depressed is described with reference to FIG. 3.

Figure 3:
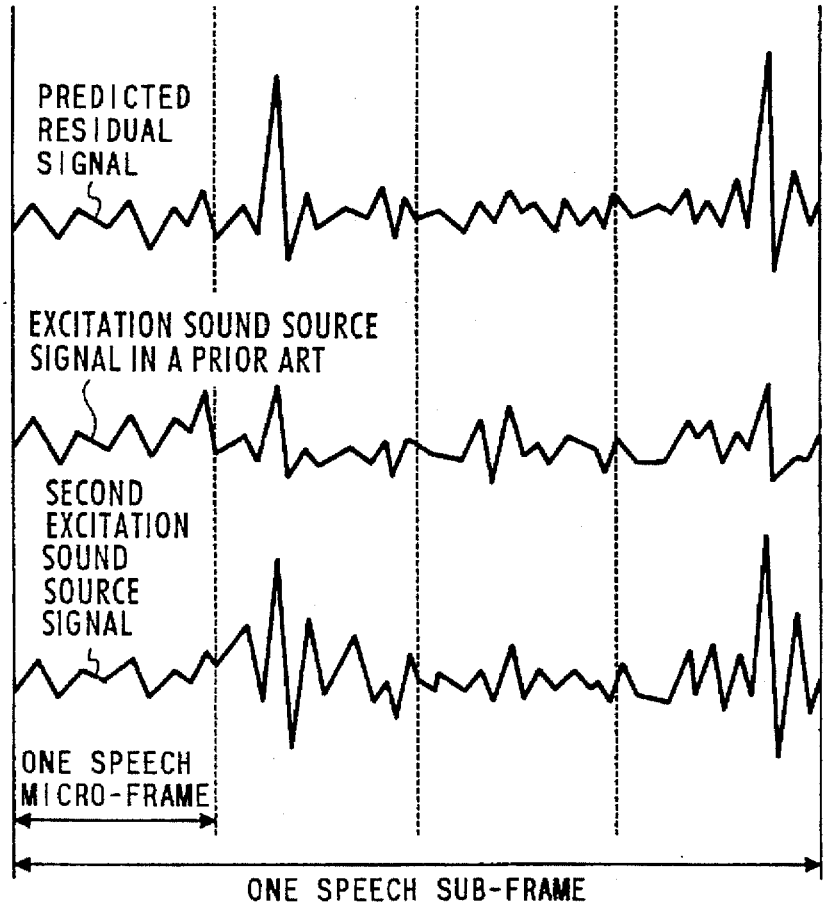
FIG. 3 shows an example of a predicted residual signal, an example of an excitation sound source signal obtained in the conventional speech coding apparatus shown in FIG. 1 and an example of a second excitation sound source signal generated by connecting a series of short-length sound source signals of a short-length signal code book shown in FIG. 2.

FIG. 3 shows an example of the predicted residual signal, an example of the excitation sound source signal obtained in the conventional speech coding apparatus 11 and an example of the second, excitation sound source signal generated by connecting the short-length sound source signals of the short-length signal code book 31. The signals are shown in one speech sub-frame composed of a plurality of speech micro-frames As shown in FIG. 3, in cases where the predetermined sound source signal having the length of one speech sub-frame is selected and the gain of the predetermined sound source signal is appropriately adjusted in the conventional speech coding apparatus 11, when the predicted residual signal locally has a peak, the excitation sound source signal in the conventional speech coding apparatus 11 cannot express the predicted residual signal with a high accuracy. In contrast, in cases where the short-length sound source signals are taken out from the short-length signal code book 31 for each speech micro-frame and gains of the short-length sound source signals are adjusted, even though the predicted residual signal locally has a peak, the second excitation sound source signal according to this embodiment can express the predicted residual signal with a high accuracy.

In this embodiment, a plurality of input speech signals Sin are analyzed in the predicted residual signal calculating unit 33 as a detecting means for detecting the depression of the function of the first code book 14. Thereafter, the depression of the function of the first code book 14 is detected or predicted according to a result of the analysis. Therefore, it is applicable that a predicting means for predicting the depression of the function of the first code book 14 by using a plurality of parameters obtained by analyzing the past and current input speech signals according to a predetermined rule based on a statistic method be arranged in place of the predicted residual signal calculating unit 33.

Also, in this embodiment, because a signal length of each short-length sound source signal of the short-length signal code book 31 is shorter than that of each predetermined sound source signal of the second and third code books 15 and 21, the number of short-length sound source signals stored in the short-length signal code book 31 to form the second excitation sound source signal can be reduced as compared with the number of predetermined sound source signals stored in the second or third code book 15 or 21 in the conventional speech coding apparatus 11 on condition that the second, excitation sound source signal can express the predicted residual signal with a high accuracy. Therefore, in cases where the number of short-length sound source signals stored in the short-length signal code book 31 is relatively reduced and gains of the short-length sound source signals respectively having one speech micro-frame are information-compressed according to a vector quantization method or the like, an amount of transmission information in the speech coding apparatus 30 can be set to the same as that in the conventional speech coding apparatus 11 in which the sound source signals are linearly added to form the excitation sound source signal according to a conventional excitation sound source generating method.

Next, the selection of a plurality of-short-length sound source signals taken out from the short-length signal code book 31 in series and the generation of a second excitation sound source signal from the short-length sound source signals selected are described with reference to FIGS. 4 and 5.

Figure 4:
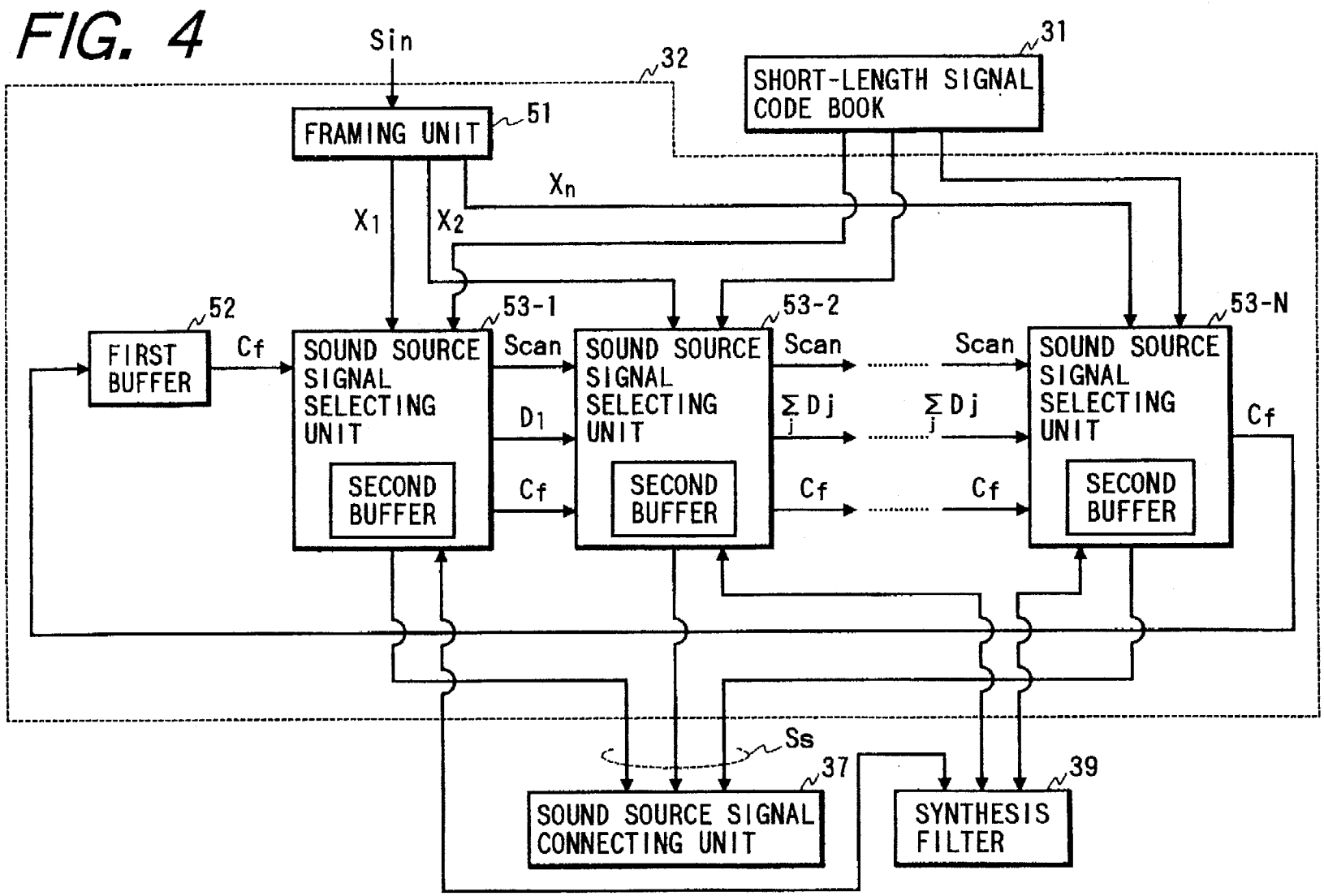
FIG. 4 is a block diagram of a short-length sound source signal selecting unit shown in FIG. 2 according to this embodiment.

FIG. 4 is a block diagram of the short-length sound source signal selecting unit 32 according to this embodiment.

As shown in FIG. 4, the short-length sound source signal selecting unit 32 comprises a framing unit 51 for subdividing one speech sub-frame of current input sound source signal Sin into a plurality of speech micro-frame of subdivided input sound source signals Xj (j=1 to N) respectively having one speech micro-frame length, a first buffer 52 for storing a synthesis filter condition Cf, and a plurality of sound source signal selecting units 53-j respectively having a second buffer for respectively receiving one of the subdivided input sound source signals Xj subdivided in the framing unit 51, respectively selecting a plurality of short-length sound source signals Scan transferred from the short-length signal code book 31 as candidates according to the synthesis filter condition Cf, and calculating a sum of an error.

The synthesis filter condition Cf is defined as a plurality of past synthesized speech signals to express sub-divided input sound source signals $X_j$ of a speech sub-frame of input sound source signal Sin input just before the current input sound source signal Sin.

In the above configuration, an operation performed in the short-length sound source signal selecting unit 32 is described.

In the framing unit 51, one speech sub-frame of current input sound source signal Sin is subdivided into N subdivided input sound source signals $X_j$ (j=1 to N) respectively having one speech micro-frame length, and one of the subdivided input sound source signals $X_j$ is input to each of the sound source signal selecting units 53-j. That is, a subdivided input sound source signal $X_j$ is input to the sound source signal selecting unit 53-j. In the sound source signal selecting unit 53-1, an influence of the synthesis filter condition Cf stored in the first buffer 52 is removed from the subdivided input sound source signal $X_1$, all of short-length sound source signals stored in the short-length signal code book 31 are transferred to the sound source signal selecting unit 53-1, an error (or a difference) $D_1$ between the speech micro-frame of subdivided input sound source signal $X_1$ and each of speech micro-frame of synthesized speech signals generated from the short-length sound source signals in the synthesis filter 39 is calculated, and M short-length sound source signals Scan are selected as candidates from among the short-length sound source signals transferred from the short-length signal code book 31 on condition that M errors (or M differences) $D_1$ relating to the M short-length sound source signals Scan are the M lowest values. An error $D_j$ between the speech micro-frame of subdivided input sound source signal $X_j$ and a speech micro-frame of synthesized speech signal generated from a short-length sound source signal relating to the subdivided input sound source signal $X_j$ in the synthesis filter 39 is expressed according to an equation (4).

$$D_j = \sum_{i=1}^{K-1} \{X_j(i) - Szir_j(i) - \gamma_j y_j(i)\}^2 \tag{4}$$

Here, because there are K sampling points in each of the speech micro-frames, the subdivided input sound source signal $X_j$ is divided into K samples $X_j(i)$. A symbol $Szir_j(i)$ denotes a zero-input response of the synthesis filter 39 which is equivalent to the synthesis filter condition Cf for the sample $X_j(i)$. By subtracting the zero-input response $Szir_j(i)$ of the synthesis filter 39 from the sample $X_j(i)$, the influence of the synthesis filter condition Cf stored in the first buffer 52 is removed from the subdivided input sound source signal $X_j$. Also, a symbol $y_j$ denotes a zero condition response of the synthesis filter 39 for a speech micro-frame of synthesized speech signal generated from a speech micro-frame of short-length sound source signal relating to the subdivided input sound source signal $X_j$, and a symbol $\gamma_j$ denotes an appropriate gain of the short-length sound source signal.

Thereafter, the M short-length sound source signals Scan selected as candidates in the sound source signal selecting unit 52-1, the M errors $D_1$ relating to the M short-length sound source signals Scan in one-to-one correspondence and the synthesis filter condition Cf are stored in the second buffer of the selecting unit 52-1, and the M short-length sound source signals Scan selected as candidates, the M errors $D_1$ calculated and the synthesis filter condition Cf are transferred to the sound source signal selecting unit 52-2.

In the selecting unit 52-2, an influence of the synthesis filter condition Cf transferred is removed from the subdivided input sound source signal $X_2$, all of short-length sound source signals stored in the short-length signal code book 31 are transferred to the sound source signal selecting unit 53-2, and an error $D_2$ between the speech micro-frame of subdivided input sound source signal $X_2$ and each of speech micro-frame of synthesized speech signals generated from the short-length sound source signals in the synthesis filter 39 is calculated. Thereafter, an accumulated error $D_1+D_2$ is calculated by adding each of the M errors $D_1$ and each of the errors $D_2$ relating to the short-length sound source signals transferred from the short-length signal code book 31, and M short-length sound source signals Scan are selected as candidates in the selecting unit 52-2 from among the short-length sound source signals transferred from the short-length signal code book 31 on condition that M accumulated errors $D_1+D_2$ relating to the M short-length sound source signals Scan are the M lowest values among all of the accumulated errors $D_1+D_2$. Thereafter, the M short-length sound source signals Scan selected as candidates in the sound source signal selecting unit 52-2, the M errors $D_2$ relating to the M short-length sound source signals Scan in one-to-one correspondence and the synthesis filter condition Cf are stored in the second buffer of the selecting unit 52-2, and the M short-length sound source signals Scan selected as candidates in the selecting unit 52-2, the M accumulated errors $D_1+D_2$ calculated and the synthesis filter condition Cf are transferred to the sound source signal selecting unit 52-3.

Thereafter, M short-length sound source signals Scan are selected as candidates in each of the selecting units 53-j on condition that M accumulated errors $\Sigma(D_j)$ are the M lowest values, in the same manner. Finally, in the sound source signal selecting unit 53-n, a short-length sound source signal transferred from the short-length signal code book 31 is selected on condition that a selected accumulated error $\Sigma(D_j)$ relating to the short-length sound source signal is the lowest value among other accumulated errors $\Sigma(D_j)$ relating to other short-length sound source signals transferred from the short-length signal code book 31. Thereafter, one short-length sound source signal relating to the selected accumulated error $\Sigma(D_j)$ is selected from each of the sound source signal selecting units 53-j to determine N short-length sound source signals Ss respectively having one speech micro-frame length. Thereafter, a new synthesis filter condition Cf for the N short-length sound source signals Ss determined is stored in the first buffer 52 to replace the synthesis filter condition Cf previously stored. Also, the N short-length sound source signals Ss determined are transferred from the selecting units 53-J to the sound source signal connecting unit 37 to connect the N short-length sound source signals in series, and a second excitation sound source signal having one speech sub-frame length is formed.

An example (N=4 and M=2) of the selection of the N short-length sound source signals is described with reference to FIG. 5.

Figure 5:
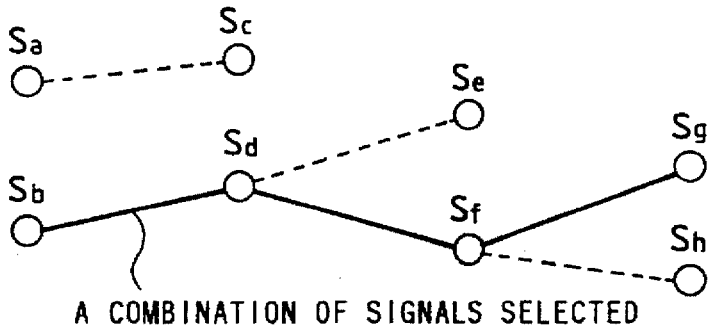
FIG. 5 shows an example of a process for selecting a series of short-length sound source signals from the short-length signal code book to form a second excitation sound source signal.

FIG. 5 shows an example of a process for selecting a series of short-length sound source signals from the short-length signal code book 31 to form a second excitation sound source signal.

As shown in FIG. 5, in the sound source signal selecting unit 52-1, two short-length sound source signals Sa and Sb are selected as candidates because two errors $D_1a$ and $D_1b$ relating to the short-length sound source signals Sa and Sb are the two lowest values among other errors $D_1$. In the sound source signal selecting unit 52-2, because accumulated values ($D_1a+D_2c$) and ($D_1b+D_2d$) are the two lowest values among other accumulated values ($D_1a+D_2$) and ($D_1b+D_2$), two short-length sound source signals Sc and Sd relating to two errors $D_2c$ and $D_2d$ are selected as candidates. In the sound source signal selecting unit 52-3, because accumulated values ($D_1b+D_2d+D_3e$) and ($D_1b+D_2d+D_3f$) are the two lowest values among other accumulated values ($D_1a+D_2c+D_3$) and ($D_1b+D_2d+D_3$), two short-length sound source signals Se and Sf relating to two errors $D_3e$ and $D_3f$ are selected as candidates. In the sound source signal selecting unit 52-4, because accumulated values ($D_1b+D_2d+D_3f+D_4g$) and ($D_1b+D_2d+D_3f+D_4h$) are the two lowest values among other accumulated values ($D_1a+D_2c+D_3e+D_4$) and ($D_1b+D_2d+D_3f+D_4$), two short-length sound source signals Sg and Sh relating to two errors $D_3g$ and $D_3h$ are selected as candidates. Because the accumulated value ($D_1b+D_2d+D_3f+D_4g$) is lower than the accumulated value ($D_1b+D_2d+D_3f+D_4h$), the short-length sound source signal Sg is selected as a part of the second excitation sound source signal. Thereafter, the short-length sound source signals Sb, Sd and Sf placed on a solid line of FIG. 5 are selected. Therefore, the second excitation sound source signal composed of the short-length sound source signals Sb, Sd, Sf and Sg is formed in the connecting unit 37.

Accordingly, because a plurality of short-length sound source signals taken out from the short-length signal code book 31 are selected under the control of the short-length sound source signal selecting unit 32, the input speech signal Sin having a local peak can be expressed by an appropriate synthesized speech signal with a high accuracy, and a speech quality of the synthesized speech signal can be improved.

Also, because the N short-length sound source signals are determined on condition that the accumulated errors relating to the N short-length sound source signals are set as low as possible and the influence of the synthesis filter condition Cf given to the selection of the N short-length sound source signals is removed, the second excitation sound source signal from which the synthesis sound source signal having a smaller difference from the speech sub-frame of current input speech signal Sin is generated in the synthesis filter 39 can be generated in the speech coding apparatus 30. In particular, in cases where one speech micro-frame length is 20 samples (K=20) at the most, the influence of the synthesis filter condition Cf on the speech micro-frame of input speech signal $X_j$ is increased. Therefore, the removal of the influence of the synthesis filter condition Cf is useful.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

What is claimed is:

1. A speech coding apparatus, comprising:

a first code book for storing a plurality of first sound source signals respectively having a first length;

a short-length signal code book for storing a plurality of short-length sound source signals respectively having a second length shorter than the first length;

function detecting means for analyzing a current input speech signal to detect whether or not a function of the first code book is depressed;

selecting means for selecting the first code book to take out a first sound source signal from the first code book in cases where it is detected by the function detecting means that the function of the first code book is not depressed and selecting the short-length signal code book to take out a plurality of short-length sound source signals from the short-length signal code book in cases where it is detected by the function detecting means that the function of the first code book is depressed, a total length of the short-length sound source signal being equal to the first length;

a synthesis filter for generating a synthesized speech signal from the first sound source signal or the short-length sound source signals which are taken out from the first code book or the short-length signal code book selected by the selecting means; and controlling means for controlling the first sound source signal or the short-length sound source signals which are taken out from the first code book or the short-length signal code book selected by the selecting means to reduce a difference between the current input speech signal and the synthesized speech signal generated by the synthesis filter.

2. A speech coding apparatus according to claim 1 in which the first sound source signals stored in the first code book are formed of a past input speech signal preceding to the current input speech signal.

3. A speech coding apparatus according to claim 1 in which the first length of the first sound source signal stored in the first code book is equal to a length of one speech sub-frame, and the second length of the short-length sound source signal stored in the short-length signal code book is equal to a length of one speech micro-frame obtained by dividing the speech sub-frame.

4. A speech coding apparatus according to claim 1 in which the function detecting means comprises:

prediction residual signal calculating means for calculating a predicted residual signal indicating a predicted residual between the current input speech signal and a predicted input speech signal; and cross-correlation calculating means for calculating a cross-correlation between the first sound source signal taken out from the first code book and the predicted residual signal calculated by the prediction residual signal calculating means to detect the depression of the function of the first code book according to a degree of the cross-correlation.

5. A speech coding apparatus according to claim 4, further including:

linear prediction analyzing means for analyzing the current input speech signal and a past input speech signal preceding to the current input speech signal to calculate a plurality of linear prediction coefficients, the predicted input speech signal used in the prediction residual signal calculating means being predicted by using the linear prediction coefficients.

6. A speech coding apparatus according to claim 1, further including:

sound source signal connecting means for connecting the short-length sound source signals taken out from the short-length signal code book in series, the short-length sound source signals connected in series being changed to the synthesized speech signal in the synthesis filter.

7. A speech coding apparatus according to claim 1, further including:

a second code book for storing a plurality of predetermined sound source signals respectively having the first length; and adding means for linearly adding the first sound source signal taken out from the first code book and a predetermined sound source signal taken out from the second code book to form an excitation sound source signal, the synthesized speech signal being generated from the excitation sound source signal in the synthesis filter.

8. A speech coding apparatus according to claim 1 in which the controlling means comprises:

framing means for dividing the current input sound source signal having he first length into a plurality of divided input sound source signals respectively having the second length; and short-length sound source signal selecting means having a plurality of signal selectors arranged in stages $ST_1$ to $ST_n$ for receiving the divided input sound source signals divided by the framing means in the signal selectors in one-to-one correspondence, calculating a plurality of signal errors between the divided input sound source signal and a plurality of synthesized speech signals generated from the short-length sound source signals of the short-length signal code book in the synthesis filter in each of the signal selectors, calculating a plurality of accumulated signal errors in each of the signal selectors $ST_k$ (k=2 to n) by adding a limited number of particular accumulated signal errors which are lower than other accumulated signal errors in a signal selector $ST_{k-1}$ and the signal errors calculated in the signal selector $ST_k$ to select the limited number of particular accumulated signal errors which are lower than the other accumulated signal errors in the signals selector $ST_k$, determining a selected accumulated signal error having the lowest value among the particular accumulated signal errors in a final stage $ST_n$, and selecting a particular short-length sound source signal relating to the selected accumulated signal error from among the short-length sound source signals of the short-length signal code book in each of the signal electors $ST_1$ to $ST_n$, the synthesized speech signal being generated from the particular short-length sound source signals selected in the signal selectors $ST_1$ to $ST_n$.

9. A speech coding apparatus, comprising:

a first code book for storing a plurality of past sound source signals respectively having a first length of one speech sub-frame, the past sound source signals being formed of a past input speech signal preceding to a current input speech signal currently input;

a second code book for storing a plurality of predetermined sound source signals respectively having the first length of one speech sub-frame length;

a short-length signal code book for storing a plurality of short-length second source signals respectively having a second length of one micro-frame shorter than the first length, a plurality of a leech micro-frames being formed by dividing one speech sub-frame;

linear prediction analyzing means for analyzing the past input speech signal and the current input speech signal to calculate a plurality of linear prediction coefficients;

prediction residual signal calculating means for calculating a predicted residual signal indicating a predicted residual between the current input speech signal and a predicted input speech signal which is obtained by using the linear prediction coefficients calculated by the linear prediction analyzing means;

cross-correlation calculating means for calculating a cross-correlation between a past sound source signal taken out from the first code book and the predicted residual signal calculated by the prediction residual signal calculating means to detect a depression of a function of the first code book according to a degree of the cross-correlation;

adding means for linearly adding the past sound source signal taken out from the first code book and a predetermined sound source signal taken out from the second code book to form a first excitation sound source signal, a total length of the first excitation sound source signal being equal to the first length;

short-length signal connecting means for connecting a plurality of short-length sound source signals taken out from the short-length signal code book in series to form a second excitation sound source signal, a total length of the second excitation sound source signal being equal to the first length;

selecting leans for selecting the first excitation sound source signal obtained in the adding means in cases where it is detected by the cross-correlation calculating means that the function of the first code book is not depressed and selecting the second excitation sound source signal obtained in the short-length signal connecting means in cases where it is detected by the cross-correlation calculating means that the function of the first code book is depressed;

a synthesized filter for generating a synthesized speech signal from the first excitation sound source signal or the second excitation sound source signal selected by the selecting means according to the linear prediction coefficients calculated by the linear prediction analyzing means; and controlling means for controlling the past sound source signal taken out from the first code book to the adding means and the short-length sound source signals taken out from the short-length signal code book to reduce a difference between the current input speech signal and the synthesis speech signal generated by the synthesized speech signal generated by the synthesis filter.

10. A speech coding apparatus according to claim 9 in which the controlling means comprises;

framing means for dividing the current input sound source signal having a first length into a plurality of divided input sound source signals respectively having the second length; and short-length sound source signal selecting means having a plurality of signal selectors arranged in stages $ST_1$ to $ST_n$ for receiving the divided input sound source signals divided by the framing means in the signal selectors in one-to-one correspondence, calculating a plurality of signal errors between the divided input sound source signal and a plurality of synthesized speech signals generated from the short-length sound source signals of the short-length signal code book in the synthesis filter in each of the signal selectors, calculating a plurality of accumulated signal errors in each of the signal selectors $ST_k$ (k=2 to n) by adding a limited number of particular accumulated signal errors which are lower than other accumulated signal errors in a signal selector $ST_{k-1}$ and the signal errors calculated in the signal selector $ST_k$ to select the limited number of particular accumulated signal errors which are lower than the other accumulated signal errors in the signals selector $ST_k$, determining a selected accumulated signal error having the lowest value among the particular accumulated signal errors in a final stage $ST_n$, and selecting a particular short-length sound source signal relating to the selected accumulated signal error from among the short-length sound source signals of the short-length signal code book in each of the signal selectors $ST_1$ to $ST_n$, the synthesized speech signal being generated from the particular short-length sound source signals selected in the signal selectors $ST_1$ to $ST_n$.

* * * * *